US008465095B2

(12) United States Patent
Su

(10) Patent No.: US 8,465,095 B2
(45) Date of Patent: Jun. 18, 2013

(54) CHAIR WITH TILTABLE BACK

(76) Inventor: Ken Su, Taoyuan County (TW)

( * ) Notice: Subject to any disclaimer, the term of this patent is extended or adjusted under 35 U.S.C. 154(b) by 287 days.

(21) Appl. No.: 12/954,679

(22) Filed: Nov. 26, 2010

(65) Prior Publication Data

US 2012/0091774 A1 Apr. 19, 2012

(30) Foreign Application Priority Data

Oct. 14, 2010 (CN) ..... 2010 2 0568362 U

(51) Int. Cl.
*A47C 1/024* (2006.01)
*A47C 1/032* (2006.01)

(52) U.S. Cl.
USPC ..... 297/354.1; 297/354.11; 297/301.1

(58) Field of Classification Search
USPC ..... 297/354.1, 354.11, 301.1, 300.1, 297/300.2
See application file for complete search history.

(56) References Cited

U.S. PATENT DOCUMENTS

| | | | | |
|---|---|---|---|---|
| 6,709,060 | B1 * | 3/2004 | Su | 297/440.2 |
| 7,484,802 | B2 * | 2/2009 | Beyer et al. | 297/284.3 |
| 7,568,765 | B2 * | 8/2009 | Brauning | 297/354.1 |
| 7,775,601 | B2 * | 8/2010 | Wu | 297/452.3 |
| 7,837,273 | B1 * | 11/2010 | Ratza et al. | 297/452.56 |

* cited by examiner

*Primary Examiner* — Sarah B McPartlin

(57) ABSTRACT

The chair of the invention includes a cushion, a back and a back support. Either or both of the back and back support are made of a flexible material. The back is perpendicular to the cushion and has an upper connecting portion and a lower connecting portion. The back support is of a substantial L-shape and has an upper end and a protrudent mount. The back support is connected between the cushion and the back for supporting the back. The upper end of the back support fixedly connects with the upper connecting portion, and the protrudent mount movably and pivotally connects with the lower connecting portion, thereby the back support is capable of tilting.

6 Claims, 8 Drawing Sheets

CHAIR WITH TILTABLE BACK

BACKGROUND OF THE INVENTION

1. Technical Field

The invention relates to chairs, particularly to chairs with swingable backs.

2. Related Art

Chairs are necessary furniture in everyday life. Usually, chairs with tiltable backs, such as office chairs, are used in offices because they make users feel comfortable.

A conventional chair with tiltable back always installs a multifunctional chassis under the cushion for making the back tiltable and lockable. This kind of multifunctional chassis, however, must be complicated, expensive and fragile. Furthermore, in the structure of the conventional chair, the back is firmly fixed on the rear side of the cushion. In other words, the cushion must moves with the back, no matter what angle the back tilts to. Usually, the back is perpendicular to the cushion. That is to say, when a user leans back in the chair, his/her body is still supported by the cushion and back which are perpendicular. Thus the waist of the user must lack support from the back. This results from that the back can not move relative to the cushion.

SUMMARY OF THE INVENTION

An object of the invention is to provide a chair with tiltable back which has low costs and durable and can make users more comfortable.

To accomplish the above object, the chair of the invention includes a cushion, a back and a back support. Either or both of the back and back support are made of a flexible material. The back is perpendicular to the cushion and has an upper connecting portion and a lower connecting portion. The back support is of a substantial L-shape and has an upper end and a protrudent mount. The back support is connected between the cushion and the back for supporting the back. The upper end of the back support fixedly connects with the upper connecting portion, and the protrudent mount movably and pivotally connects with the lower connecting portion, thereby the back support is capable of tilting.

DETAILED DESCRIPTION OF THE INVENTION

Figure 1:
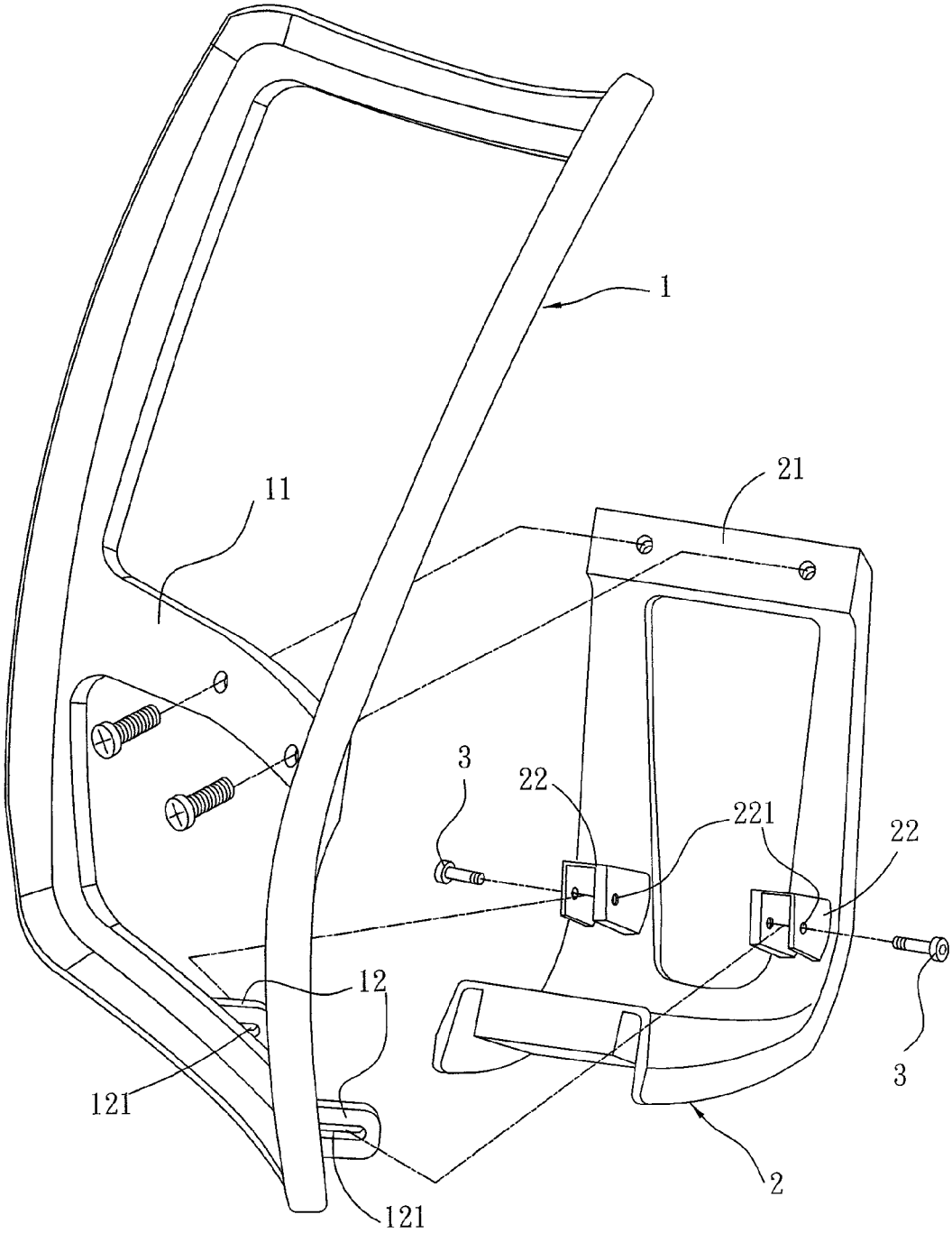
FIG. 1 is an exploded view of the invention.
Figure 2:
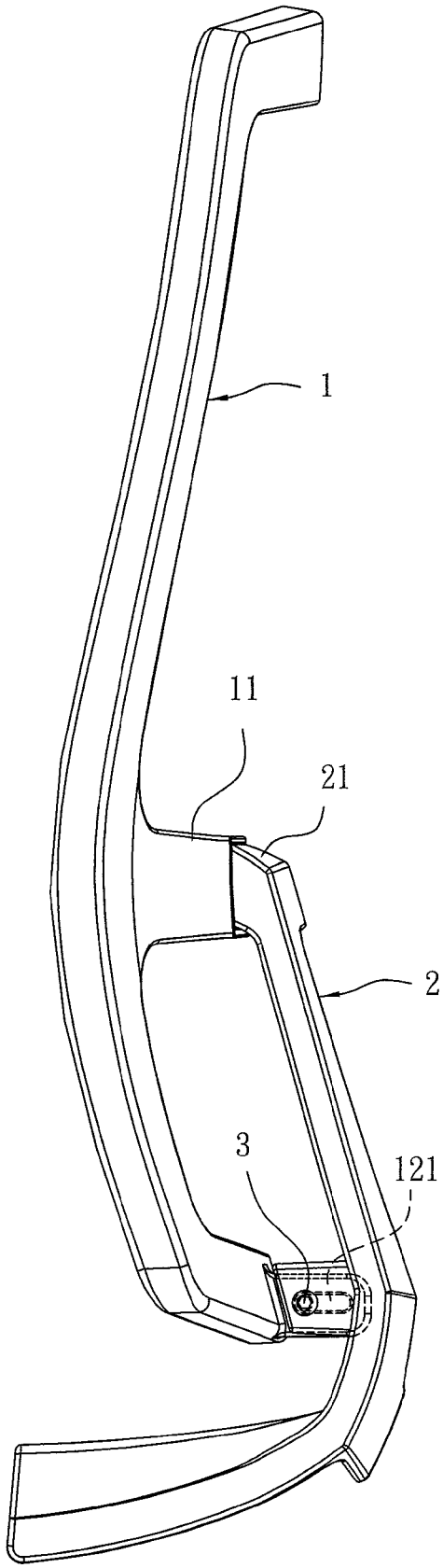
FIG. 2 is an assembled view of the invention.
Figure 3:
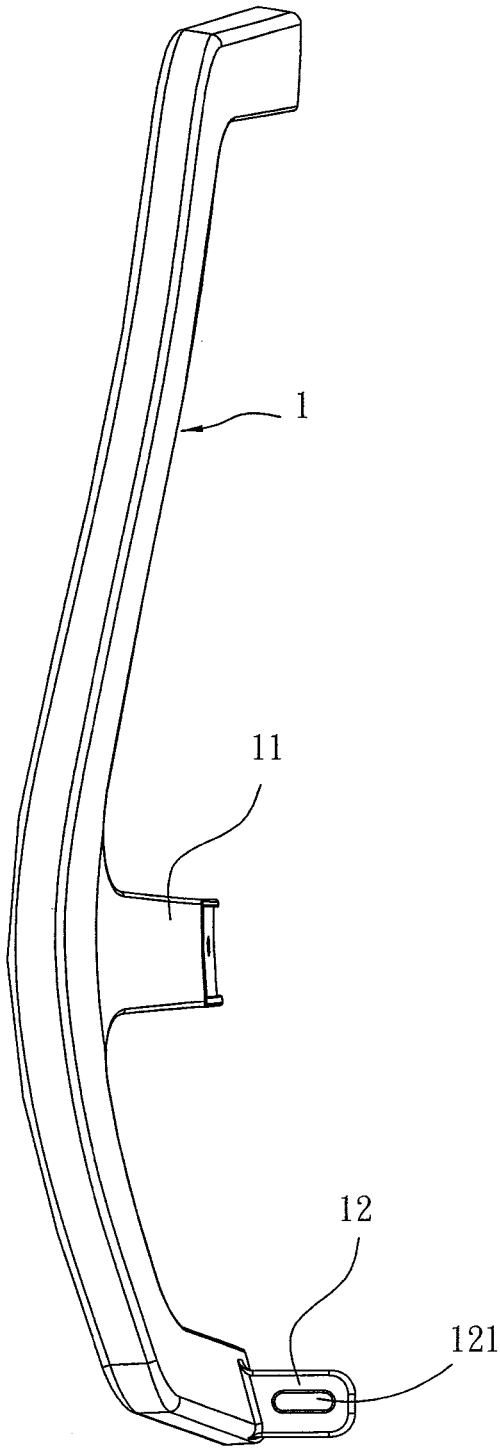
FIG. 3 is a schematic view of the back.
Figure 4:
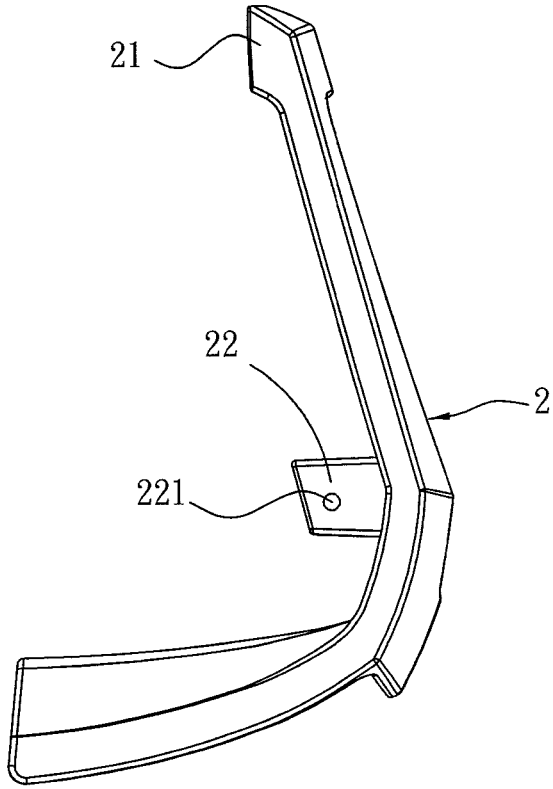
FIG. 4 is a schematic view of the back support.

Please refer to FIGS. 1-4. The chair of the invention includes a back 1 and a back support 2. Either or both of the back 1 and back support 2 are made of a firm and flexible material such as nylon with fiber. The back 1 has an upper connecting portion 11 and two lower connecting portions 12. The upper connecting portion 11 and the lower connecting portions 12 are located at the middle and the lower end of the back 1, respectively. The back support 2 is of a substantial L-shape and has an upper end 21 and two protrudent mounts 22. The back 1 is assembled with the back support 2. The upper end 21 of the back support 2 fixedly connects with the upper connecting portion 11, and the protrudent mounts 22 movably and pivotally connects with the lower connecting portions 12, thereby the back 1 is capable of swinging against the back support 2.

In a preferred embodiment, each of the lower connecting portions 12 is provided with a long hole 121, and each of the protrudent mounts 22 is provided with a round hole 221. And the lower connecting portions 12 are separately inserted into the protrudent mounts 12 so as to overlap the long holes 121 and the round holes 221. The long holes 121 and the round holes 221 are separately penetrated by two shaft bars 3. Thus the back 1 can be swung because the shift of the shaft bars 3 in the long holes 121.

Figure 5:
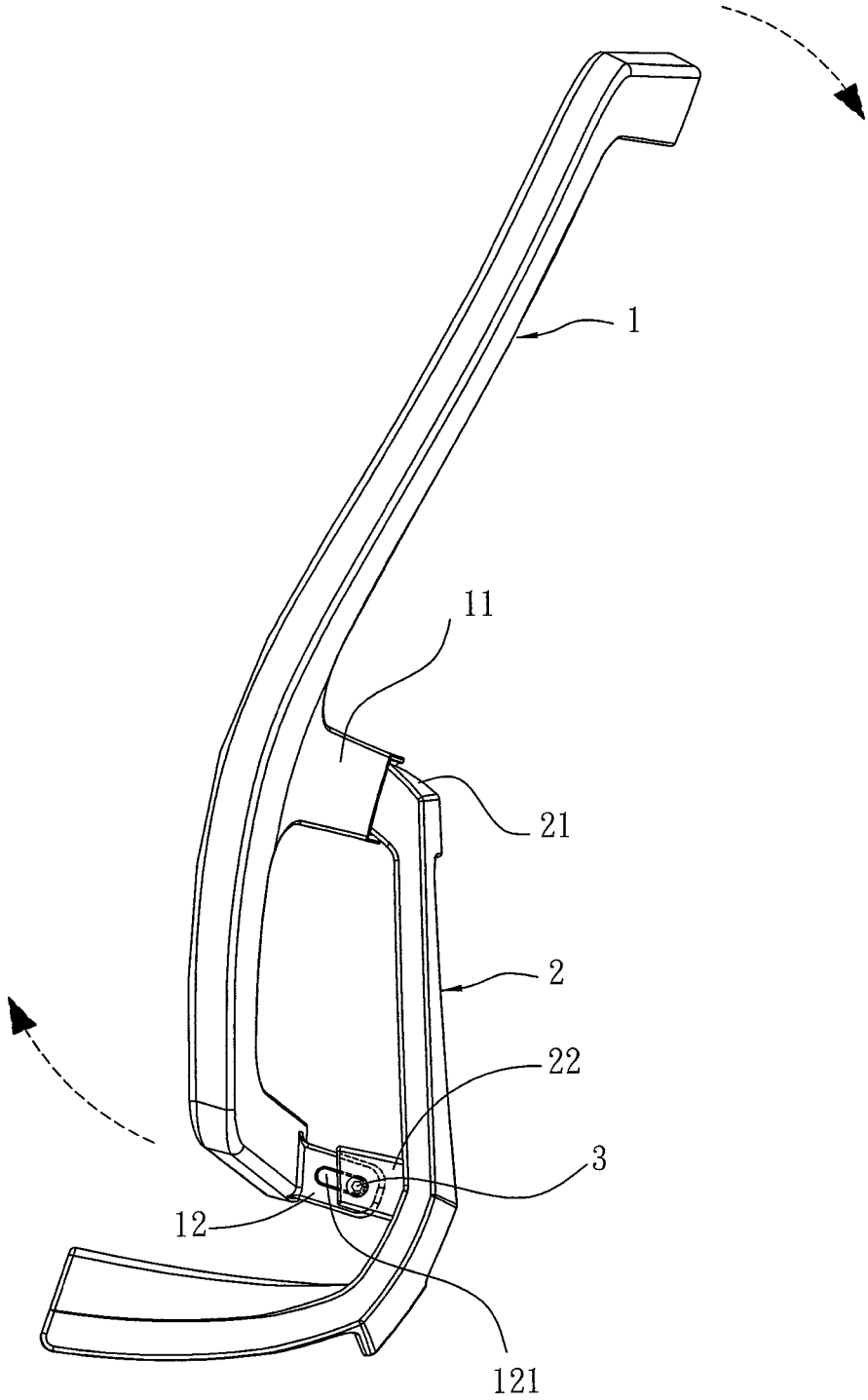
FIG. 5 shows the movement of the back against the back support.

Please refer to FIG. 5. As shown, the back 1 will tilt backwards against the junction of the upper connecting portion 11 and the upper end 21 when a user leans back in the chair. At this time, the junction will be slightly deformed because of the flexibility of the back 1 and/or the back support 2. Meanwhile, the shaft bar 3 is shifting in the long hole 121. When the user leaves the chair or leans forwards, the back 1 will restore to the original position due to the flexibility.

Figure 6:
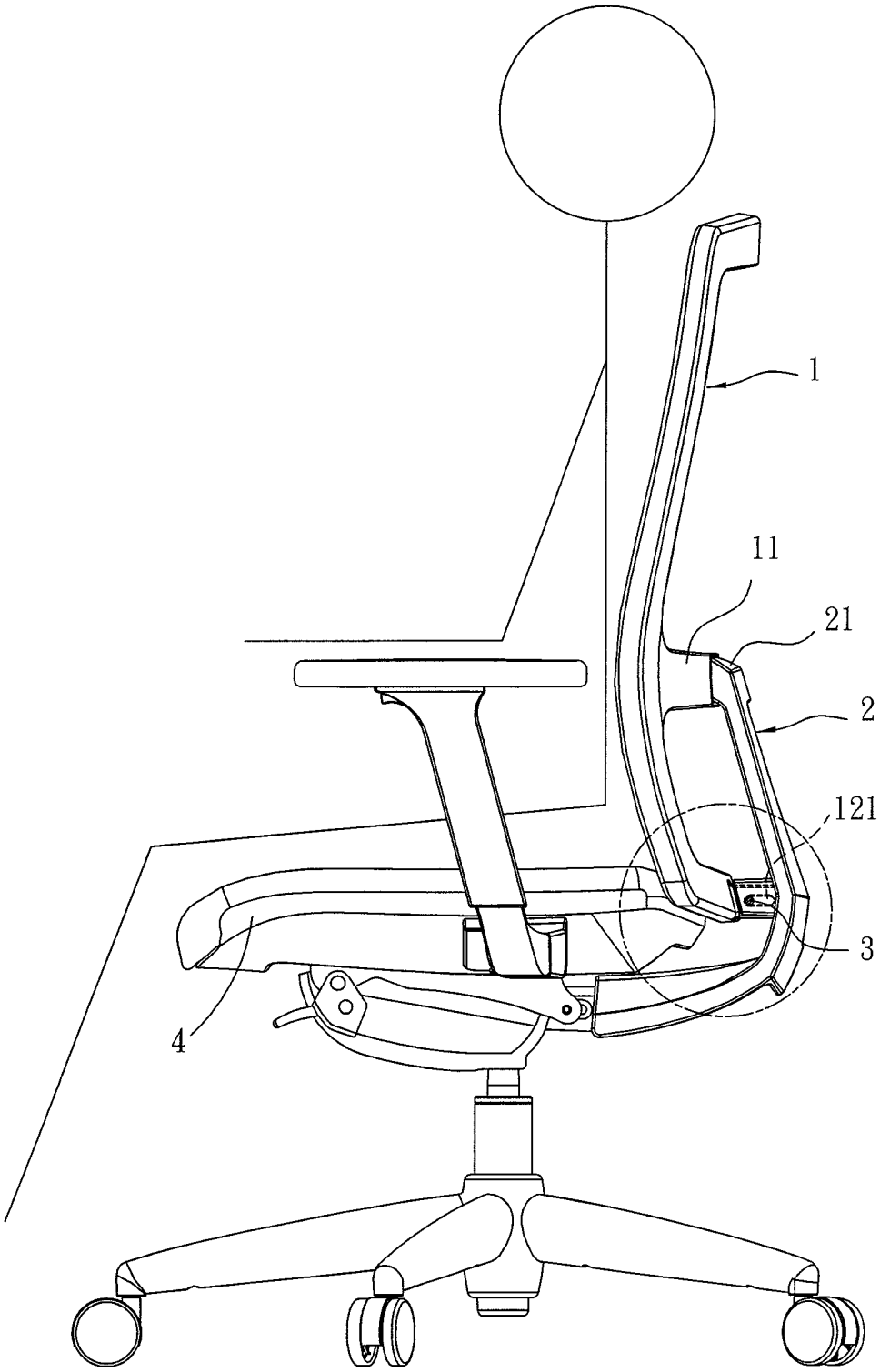
FIG. 6 is a schematic view of the invention applied in a chair and a user sitting on the chair in a leaning forwards status.
Figure 7:
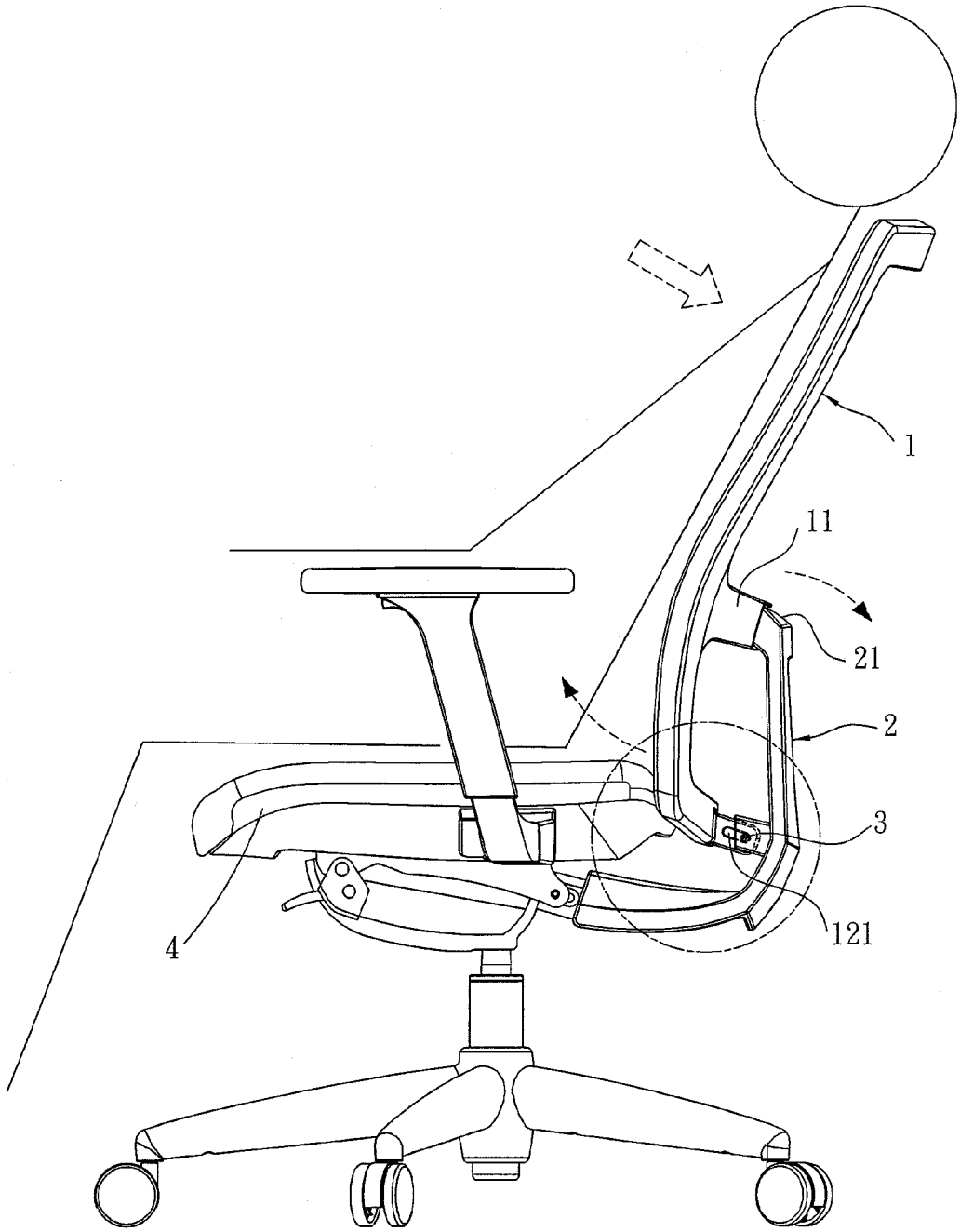
FIG. 7 is a schematic view of the invention applied in a chair and a user sitting on the chair in a leaning back status.
Figure 8:
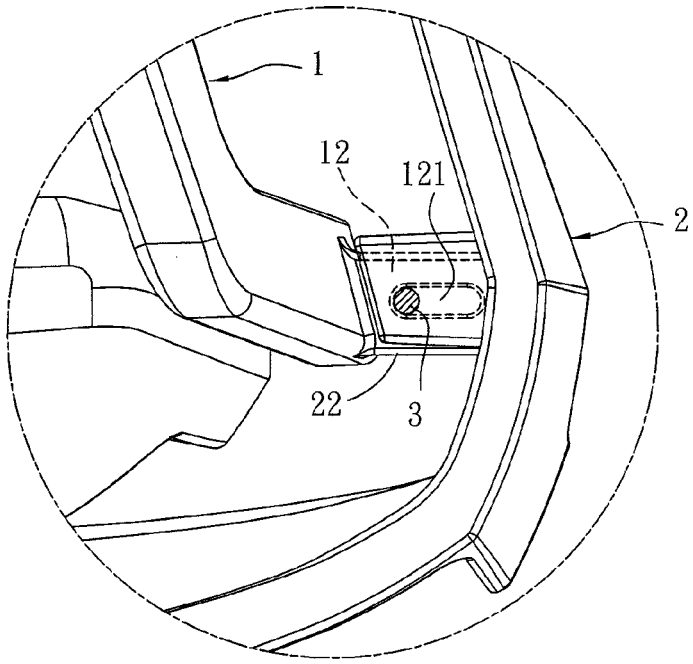
FIG. 8 is a partially enlarged view of FIG. 6.
Figure 9:
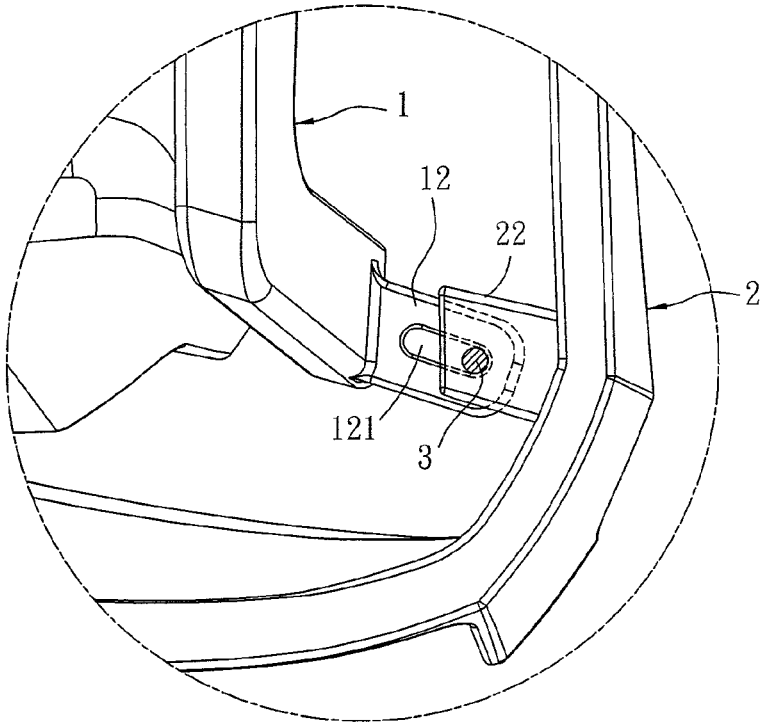
FIG. 9 is a partially enlarged view of FIG. 7.

Please refer to FIGS. 6 and 7. The two drawings illustrate the invention is applied in a chair. As shown, the back 1 is substantially perpendicular to the cushion 4. The back support 2 is connected between the cushion 4 and the back 1 for flexibly supporting the back 1. The lower section of the back support 2 is fastened under the cushion 4. As can be seen in these two drawings, no matter what angle the back 1 is tilted to, the cushion 4 always keep horizontal. When a user is leaning back on the chair, he/she will feel more comfortable than before. FIGS. 8 and 9 are two partially enlarged views of FIGS. 6 and 7, respectively, which illustrate that the shaft bars 3 are moved in the long holes 121 to make the back 1 tiltable.

It will be appreciated by persons skilled in the art that the above embodiment has been described by way of example only and not in any limitative sense, and that various alterations and modifications are possible without departure from the scope of the invention as defined by the appended claims. It will be appreciated by persons skilled in the art that the above embodiment has been described by way of example only and not in any limitative sense, and that various alterations and modifications are possible without departure from the scope of the invention as defined by the appended claims.

What is claimed is:

1. A chair with tiltable back comprising:

a cushion;

a back substantially perpendicular to the cushion, made of a flexible material, having an upper connecting portion and a lower connecting portion;

a back support having a substantial L-shape, connected between the cushion and the back for supporting the back, and having an upper end and a protrudent mount;

wherein the upper end of the back support fixedly connects with the upper connecting portion, and the protrudent mount movably and pivotally connects with the lower connecting portion;

thereby the back is capable of swinging against the back support due to a movable and pivotal connection between the protrudent mount and the lower connecting portion, the lower connecting portion is provided with a long hole, the protrudent mount is provided with a round hole, and the long hole and the round hole are penetrated by a shaft bar.

2. The chair of claim 1, wherein the flexible material is nylon with fiber.

3. The chair of claim 1, wherein the upper connecting portion and the lower connecting portion are located at middle and a lower end of the back, respectively.

4. A chair with tiltable back comprising:

a cushion;

a back substantially perpendicular to the cushion, having an upper connecting portion and a lower connecting portion;

a back support having a substantial L-shape, made of a flexible material, connected between the cushion and the back for supporting the back, and having an upper end and a protrudent mount;

wherein the upper end of the back support fixedly connects with the upper connecting portion, and the protrudent mount movably and pivotally connects with the lower connecting portion;

thereby the back support is capable of swinging due to a movable and pivotal connection between the protrudent mount and the lower connecting portion, the lower connecting portion is provided with a long hole, the protrudent mount is provided with a round hole, and the long hole and the round hole are penetrated by a shaft bar.

5. The chair of claim 4, wherein the flexible material is nylon with fiber.

6. The chair of claim 4, wherein the upper connecting portion and the lower connecting portion are located at middle and a lower end of the back, respectively.

* * * * *